US012553319B2

(12) United States Patent
Ismail

(10) Patent No.: US 12,553,319 B2
(45) Date of Patent: Feb. 17, 2026

(54) FLEXIBLE GAS LIFT OPTIMIZATION

(71) Applicant: Abu Dhabi Company for Onshore Petroleum Operations Limited, Abu Dhabi (AE)

(72) Inventor: Ahmed Mohamed M. Ismail, Abu Dhabi (AE)

(73) Assignee: Abu Dhabi Company for Onshore Petroleum Operations Limited, Abu Dhabi (AE)

( * ) Notice: Subject to any disclaimer, the term of this patent is extended or adjusted under 35 U.S.C. 154(b) by 0 days.

(21) Appl. No.: 18/721,728

(22) PCT Filed: Dec. 28, 2021

(86) PCT No.: PCT/IB2021/062374

§ 371 (c)(1),
(2) Date: Jun. 19, 2024

(87) PCT Pub. No.: WO2023/126642

PCT Pub. Date: Jul. 6, 2023

(65) Prior Publication Data

US 2025/0059861 A1 Feb. 20, 2025

(51) Int. Cl.
*E21B 47/10* (2012.01)
*E21B 43/12* (2006.01)

(52) U.S. Cl.
CPC ..... *E21B 43/122* (2013.01); *E21B 47/10* (2013.01)

(58) Field of Classification Search
CPC ..... E21B 43/122; E21B 47/10
See application file for complete search history.

(56) References Cited

U.S. PATENT DOCUMENTS 5,871,048 A 2/1999 Tokar et al.
8,670,966 B2 * 3/2014 Rashid ..... E21B 43/122 166/267

(Continued)

FOREIGN PATENT DOCUMENTS

EP 2991007 A1 3/2016
WO 2005085589 A1 9/2005
WO 2014169000 A1 10/2014

OTHER PUBLICATIONS

International Search Report and Written Opinion issued for corresponding International Patent Application No. PCT/IB2021/062374, mailed Sep. 20, 2022.

*Primary Examiner* — Aaron L Lembo
(74) *Attorney, Agent, or Firm* — Renner, Otto, Boisselle & Sklar, LLP

(57) ABSTRACT

A method comprises the steps of selecting a group of wells; defining a production target rate for the group; allocating wells operated with gas lift to a first sub-group; allocating wells operated without gas lift to a second sub-group; setting a production target rate for the first sub-group and conducting gas lift parameter optimization for at least one well of the first sub-group to obtain the production target rate for the first sub-group, and transmitting control signals to wells of the first sub-group to operate the at least one well under condition of at least one optimized gas lift parameter; monitoring the production rate of the first sub-group, and setting a production target rate for the second sub-group to obtain the difference between the production target rate for the group and the production rate of the first sub-group, and transmitting adjustment signals to the wells of the second sub-group.

19 Claims, 2 Drawing Sheets

(56) References Cited

U.S. PATENT DOCUMENTS

| | | | | |
|---|---|---|---|---|
| 10,880,625 | B2 * | 12/2020 | Sassi | E21B 47/138 |
| 11,459,862 | B2 * | 10/2022 | Watson | E21B 43/129 |
| 11,551,106 | B2 * | 1/2023 | Maucec | G06Q 10/067 |
| 2005/0199391 | A1 * | 9/2005 | Cudmore | E21B 47/07 166/250.15 |
| 2016/0153266 | A1 | 6/2016 | Rashid et al. | |
| 2020/0199977 | A1 | 6/2020 | De Mattia et al. | |

* cited by examiner

FLEXIBLE GAS LIFT OPTIMIZATION

This application is a national phase of International Application No. PCT/IB2021/062374, filed Dec. 28, 2021, which is hereby incorporated herein by reference in its entirety.

1. TECHNICAL FIELD

The present invention relates to improved methods for operating wells of an oilfield, a computer program for performing said methods and a non-transitory computer readable medium for performing said methods. Further, the present invention relates to a control unit for operating wells of an oilfield and an oilfield comprising said control unit being operated according to said methods.

2. PRIOR ART

In the field of oil production, it is known to apply gas lift to oil wells which have insufficient natural bottom hole pressure for crude oil to flow all the way to the surface. Gas lift is a method that involves injecting gas through a tubing-casing annulus into a tubing for conveying oil. The gas injected into the tubing aerates a fluid (oil) in said tubing to reduce its density, resulting in the formation of pressure. Said pressure is then able to lift the oil column in the tubing. Hence, oil is forced out of the wellbore.

Figure 3:
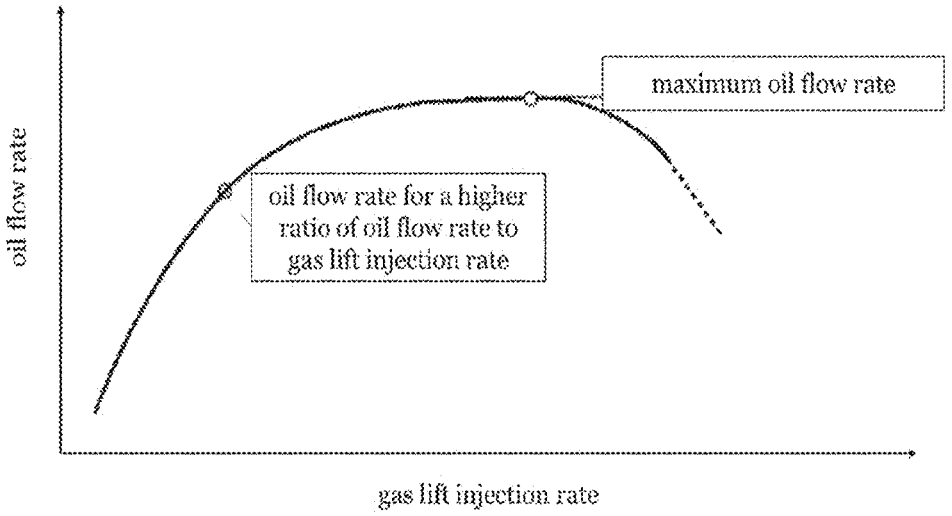

Each oil well has a maximum oil production. Said maximum oil production for each well is dependent on a gas lift injection rate, which varies based on well conditions and geometries. A gas lift injection rate which is higher or lower than the peak-conveying gas lift injection rate (i.e. the gas lift injection rate that results in the maximum oil production) will result in a lowered oil production compared to the maximum oil production. Thus, it is generally desired to avoid injecting too much gas as this causes a waste of gas and energy and thereby causes inefficiency. However, it may be advantageous to use a gas lift injection rate which is lower than the peak-conveying gas lift injection rate. This may exemplarily be the case if the ratio of an oil flow rate to a gas lift injection rate is higher and thus gas is used more efficiently. In FIG. 3 the oil flow rate in dependence of the gas lift injection rate is depicted for an exemplary well.

The optimal amount of injected gas for an individual well may be determined by well tests, where a gas lift injection rate is varied, and an oil flow rate is measured. However, these well tests are time-consuming and cannot be carried out often enough to react to the changing well characteristics.

Alternatively, mathematical models may be used to simulate the optimum gas lift injection rate for a single, individual well based on selected optimization parameters. Such gas lift parameter optimization models offer significant benefit, since they allow to simulate the performance of an actual or planned gas lift well using a digital replica of the well. With said gas lift parameter optimization models a single, individual well of an oilfield may be operated with optimized gas lift parameters.

However, when simulating and/or operating an oilfield with multiple wells which is on plateau, i.e. a condition, where the target production rate equals the actual production rate, it is not possible with any existing method to apply gas lift optimization directly, continuously and precisely to the wells and maintain a stable production rate.

In the field of oil production, it is generally assumed that none of the wells of an oilfield requires gas lift unless the oilfield cannot achieve its entire target production rate, i.e. is off plateau. Therefore, e.g. wells with a high water production will dry up due to a lack of gas lift as far as the other dry oil wells can compensate their production contribution shortfall and achieve the target production rate for the field. This results in an increased number of inactive wells and under-utilizing existing wells. Hence, expensive drilling additional wells to sustain the field production target rate may be required.

To address this problem two methods of assigning a gas lift injection rate to wells of an oilfield which is on plateau are known.

In a first method a fixed gas lift injection rate is used per well. Although this method is simple and easy to apply, there are significant disadvantages. Since the gas lift injection rate is fixed during a wells entire life, the gas lift requirement at well and field level is overestimated or underestimated. Further, no optimized gas lift distribution between different wells is possible. Moreover, no gas lift optimization over time is possible.

In a second method, first, a model of an oilfield with multiple wells is simulated with no field target production rate constrain. Thus, gas lift optimization is applied to all wells since the oilfield has no defined plateau which is to be reached. Second, the gas lift injection rate for each well over time is recorded. Last, the model is run again after setting the field target production rate constrain, and the gas lift injection rate for each well that was acquired from the first run is assigned to each well. This method also has several disadvantages. First, the gas lift requirement per well from the first run cannot be exactly synchronized with the wells production performance from the last run, where the field target rate was set. Hence, wells that can produce dry oil (zero water cut) may have a gas lift rate allocated to them. Further, the gas lift requirements on both well and field level are overestimated. Moreover, extensive work is required to assign the gas lift requirement for each well at each time step.

It is therefore an object underlying the present invention to provide at least one method for operating wells of an oilfield which allow to apply gas lift optimization directly, continuously, and precisely to the wells and maintain a stable production rate. It is also an object underlying the present invention to provide a computer program for performing said method(s) and a non-transitory computer readable medium for performing said method(s). Further, is also an object underlying the present invention to provide a control unit for operating wells of an oilfield and an oilfield comprising said control unit being operated according to said method(s).

3. SUMMARY OF THE INVENTION

This object is at least partially achieved by the teachings of the independent claims and in particular by any one of the methods for operating wells of an oilfield. It is to be understood, that individual method steps of those methods can be combined. For example, one or more method steps described with respect to the first method can be part of the second method, or vice versa.

The first method is a method for operating wells of an oilfield comprising the following steps: (a) selecting a group of wells of an oilfield; (b) defining a production target rate for the group of wells; (c) allocating wells being operated with gas lift to a first sub-group of the group of wells; (d) allocating wells being operated without gas lift to a second sub-group of the group of wells; (e) setting a production target rate for the first sub-group and conducting gas lift parameter optimization for at least one well of the first sub-group to obtain the production target rate for the first sub-group, and transmitting control signals to wells of the first subgroup to operate the at least one well under condition of at least one optimized gas lift parameter; (f) monitoring the production rate of the first sub-group; (g) setting a production target rate for the second sub-group to obtain the difference between the production target rate for the group of wells and the production rate of the first sub-group, and transmitting adjustment signals to the wells of the second sub-group.

The first method allows that a gas lift parameter optimization is conducted for one or more wells of an oilfield directly and precisely, in particular while the oilfield is operated on plateau. Further the second sub-group may compensate for production shortfalls and/or production deficits and/or production fluctuations of the first sub-group.

The second method is a method for operating wells of an oilfield comprising the following steps: (a) selecting a group of wells of an oilfield; (b) defining a production target rate for the group of wells; (c) allocating wells being operated with gas lift to a first sub-group of the group of wells; (d) allocating wells being operated without gas lift to a second sub-group of the group of wells; (e) setting a production target rate for the first sub-group; (f) monitoring the production rate of the first sub-group; (g) setting a production target rate for the second sub-group, to obtain the difference between the production target rate for the group of wells and the production rate of the first sub-group, continuously repeating the setting of the production target rate for the second sub-group such that a stable production rate for the group of wells is obtained, and transmitting adjustment signals to the wells of the second sub-group.

The second method allows that the production target rate for a group of wells of an oilfield is stably obtained, as the second sub-group may compensate for production shortfalls and/or production deficits and/or production fluctuations of the first sub-group. This is particularly beneficial as an oilfield or a group of wells of an oilfield which comprises wells being operated with gas lift and without gas lift can be stably operated on plateau.

The group of wells of an oilfield may comprise all wells of the oilfield. Further, the group of wells may comprise wells of an oilfield which are naturally defined as a group. Wells of an oilfield may be naturally defined as a group by geographic conditions and/or soil structure. Further, the group of wells may comprise wells of an oilfield which have a defined maximum distance to each other and/or are connected via the same operating infrastructure. Further, other parameters may be applied for selecting the (sub)-group of wells of an oilfield.

The production target rate for the group of wells may be a constant value or a variable value. Particularly, the production target rate may increase and/or decrease over time, wherein increase and/or decrease may be linearly and/or nonlinearly over time. Further, the production target rate may be defined as the production rate on which the group of wells presently operates.

In steps (c) and (d) no wells may be allocated to the first sub-group of the group of wells or the second sub-group of the group of wells. Exemplarily, the second sub-group may remain empty if all wells of the group of wells are operated with gas lift. Further exemplarily, the first sub-group may remain empty if all wells of the group of wells are operated without gas lift.

The first method may further comprise continuously repeating the setting of the production target rate for the second sub-group such that a stable production rate for the group of wells is obtained.

The continuous repeating of the setting of the production target rate for the second sub-group such that a stable production rate for the group of wells is obtained may compensate for production shortfalls and/or production deficits and/or production fluctuations of the first sub-group. To obtain a stable production rate for the group of wells the continuous repeating of the setting of the production target rate may be conducted time-continuous. Further, the continuous repeating of the setting of the production target rate may also be conducted at discrete time steps. In case the continuous repeating of the setting of the production target rate is conducted time-discrete, the time interval may be adapted to compensate for production shortfalls and/or production deficits and/or production fluctuations of the first sub-group. The time interval may be at least one day, optionally at least one hour, further optionally at least one minute and even further optionally at least one second. Additionally, or optionally, the time interval may be less than one day, less than one hour, less than one minute or even further less than one second.

The second method may further comprise that gas lift parameter optimization for at least one well of the first sub-group is conducted to obtain the production target rate for the first sub-group, and preferably transmitting control signals to the wells of the first subgroup to operate the at least one well under condition of the at least one optimized gas lift parameter.

Gas lift parameter optimization is understood as the optimization of parameters which are related to the process of gas lift, such as flow rate, pressure, temperature and/or the like. Thereby particularly an optimum gas lift injection rate for a well based on selected optimization parameters may be obtained. Gas lift parameter optimization may be conducted for each well which operates under parameters which are not in a defined range. The gas lift parameter optimization may optimize the parameters which are not in the defined range in order to reach the defined range.

Any one of the methods described above may further comprise a step (f1) of conducting gas lift parameter optimization for at least one well of the first sub-group to obtain the production target rate for the first sub-group, if the monitored production rate of the first sub-group does not meet the production target rate for the first sub-group, and preferably transmitting correction signals to the wells of the first subgroup to operate the at least one well under condition of the at least one optimized gas lift parameter. Thereby it is possible to continuously conduct gas lift parameter optimization while the group of wells is on plateau.

The transmission of control signals, adjustment signals and/or correction signals to the wells of the first sub-group and/or the second sub-group may comprise that at least one operating instruction is sent to at least one well. Further, the transmission of the signals may be conducted continuously.

The method comprising step (f1) may further comprise a step (f2) of identifying if the production target rate for the first sub-group was not achieved by means of gas lift parameter optimization and returning to step (e) if the production target rate for the first sub-group was not achieved by means of gas lift parameter optimization. Accordingly, if it is not possible by means of gas lift optimization to achieve the production target rate for the first sub-group, the setting of a new production target may be required. Thereby it may be ensured that the wells of the first sub-group do not operate under gas lift parameters which cannot be optimized sufficiently.

The gas lift parameter optimization may optimize a gas lift injection rate, wherein the gas lift injection rate is optionally in a range between 0.4 and 1.5 kscf/day, further optionally between 0.5 and 1.0 kscf/day and even further optionally between 0.6 and 0.8 kscf/day, wherein the unit scf denotes standard cubic foot. The range for the gas lift injection rate may be limited by a minimum value which is required to prevent a well from drying up. Further, the range for the gas lift injection rate may be limited by a maximum value which is defined by the maximum capacity of the operating infrastructure. The gas lift injection rate may be defined as the amount of gas which is utilized for the gas lift process per time unit.

The gas lift parameter optimization may optimize an oil flow rate, wherein the oil flow rate is optionally in a range between 100 and 1000 barrels/day further optionally between 150 and 900 barrels/day and even further optionally between 200 and 800 barrels/day. The range for the oil flow rate may be limited by a minimum value which is required to prevent a well from drying up. Further, the range for the oil flow rate may be limited by a maximum value which is defined by the maximum intake capacity of the operating infrastructure. The oil flow rate may be defined as the amount of oil which is flowing out of a well per time unit.

The gas lift parameter optimization may optimize a ratio of an oil flow rate to a gas lift injection rate, wherein the ratio of an oil flow rate to a gas lift injection rate is optionally in a range between 100 and 2500 barrel/kscf, further optionally between 150 and 1800 barrel/kscf and even further optionally between 250 and 1300 barrel/kscf. The range for the ratio of an oil flow rate to a gas lift injection rate may be limited by a minimum value which represents the least acceptable resource efficiency. This minimum value may be about 100 barrel/kscf (economic factor). Further, the ratio of an oil flow rate to a gas lift injection rate may be limited by a maximum value which is defined by the operating infrastructure.

The gas lift parameter optimization may optimize a value for the differentiation of an oil flow rate with respect to a gas lift injection rate. The range for the value for the differentiation of an oil flow rate with respect to a gas lift injection rate may be limited by a minimum value which represents the least acceptable increase of the oil flow rate when increasing the gas lift injection rate. Further, the range for the value for the differentiation of an oil flow rate with respect to a gas lift injection rate may be limited by a maximum value which represents highest acceptable sensitivity for the gas lift injection.

The gas lift parameter optimization may optimize a value for the differentiation of an oil flow rate with respect to a gas lift injection rate, wherein the value for the differentiation of an oil flow rate with respect to a gas lift injection rate is positive and/or not zero. Thus, a gas lift parameter optimization, wherein the gas lift injection rate increases while the oil flow rate declines may be excluded.

The wells being operated without gas lift may be naturally flowing wells. Further, the wells being operated without gas lift may also be wells which are operated by means of mechanical pumps.

Any one of the methods described above may further comprise a step (d1) of transferring a well from the second sub-group to the first sub-group if at least one predefined threshold for the well is exceeded or undershot, wherein the threshold may be that the water cut value is higher than 40%, optionally higher than 45%, and further optionally higher than 50%. By transferring a well from the second sub-group to the first sub-group it may be possible to continue operating the well even if it would dry up without gas lift support. Thus, by operating wells with gas lift which would otherwise dry out, the target production rate for the group of wells may be reached without drilling further wells.

Any one of the methods described above may further comprises a step (h) of repeating at least one of the steps (a), (b), (c), (d), (d1), (e), (f), (f1), (f2), (g). The steps may be executed and/or repeated in any order. Further, any of the steps may be executed parallel to each other. Optionally all steps are repeated in step (h).

The production target rate for the first sub-group may be set to the production target rate for the entire group. This allows optimizing the gas lift parameters, while obtaining an economical reasonable production rate from the first sub-group. The second sub-group is then utilized to achieve the intended production target rate for the group.

The invention further concerns a computer program, comprising instructions that when carried out by at least one processor, cause the at least one processor to perform for performing any one of the methods described above.

The invention further concerns a non-transitory computer readable medium having stored thereon software instructions that, when carried out by at least one processor, cause the processor to perform for performing any one of the methods described above.

The invention further concerns a control unit for operating wells of an oilfield, the control unit comprising at least one processor and a memory coupled with the at least one processor; the at least one processor and memory configured to perform any one of the methods described above.

The invention further concerns an oilfield comprising the control unit being operated according to any one of the methods described above.

4. SHORT DESCRIPTION OF THE FIGURES

Figure 1:
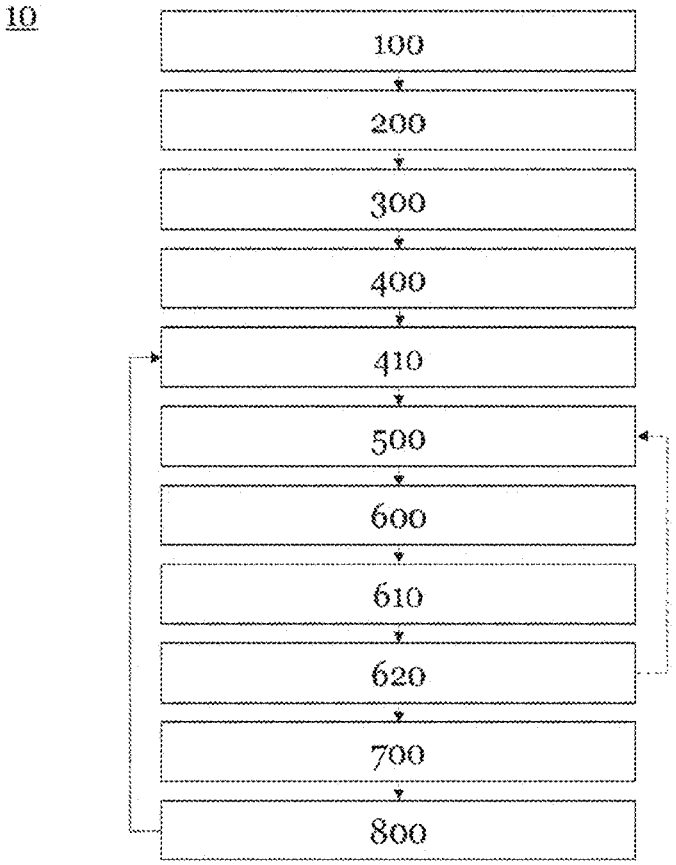

In the following, exemplary embodiments of the invention are described with reference to the figures. The figures show:

FIG. 1: shows an exemplary method for operating wells of an oilfield according to the present invention.

Figure 2:
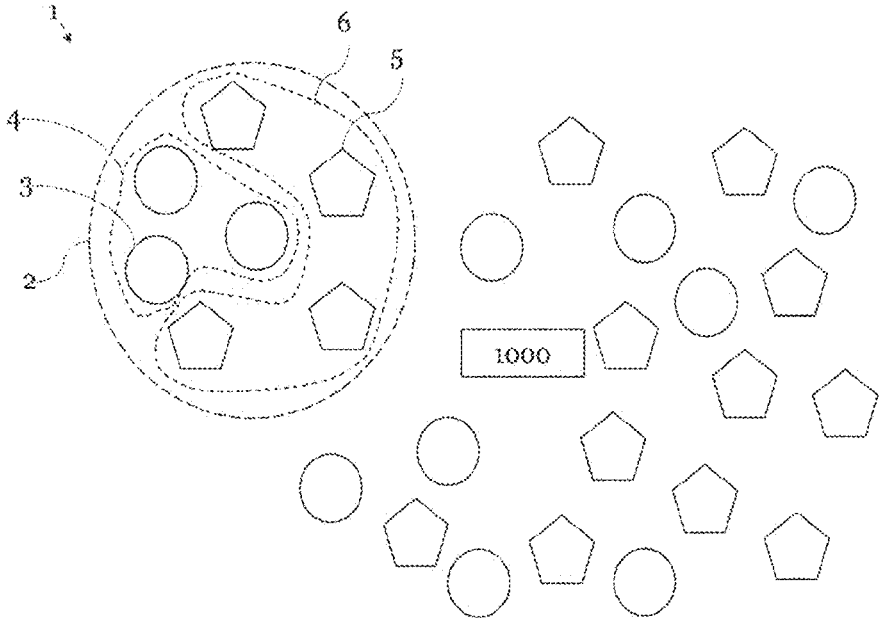

FIG. 2: shows an exemplary oilfield comprising a control unit according to the present invention.

FIG. 3: shows the oil flow rate in dependence of the gas lift injection rate for an exemplary well

5. DETAILED DESCRIPTION OF PREFERRED EMBODIMENTS

In the following, only some possible embodiments of the invention are described in detail. It is to be understood that these exemplary embodiments can be modified in a number of ways and combined with each other whenever compatible and that certain features may be omitted in so far as they appear dispensable.

FIG. 1 shows an exemplary method 10 for operating wells of an oilfield. The method comprises the following steps:

(a) selecting 100 a group 2 of wells 3, 6 of an oilfield 1;
(b) defining 200 a production target rate for the group 2 of wells;
(c) allocating 300 wells 3 being operated with gas lift to a first sub-group 4 of the group 2 of wells;
(d) allocating 400 wells 5 being operated without gas lift to a second sub-group 6 of the group 2 of wells;

(d1) optionally, transferring 410 each well 3 from the second sub-group 4 to the first sub-group 5 for which the water cut value is higher than a predefined threshold and for which the oil flow rate is below a predefined threshold;

(e) setting 500 a production target rate for the first sub-group 3 and conducting gas lift parameter optimization for at least one well 4 of the first sub-group 3 to obtain the production target rate for the first sub-group 3, and transmitting control signals to wells of the first subgroup 4 to operate the at least one well 3 under condition of at least one optimized gas lift parameter;

(f) monitoring 600 the production rate of the first sub-group;

(f1) optionally, conducting 610 gas lift parameter optimization for at least one well 3 of the first sub-group 4 to obtain the production target rate for the first sub-group 4, if the monitored production rate of the first sub-group 4 does not meet the production target rate for the first sub-group 4, and transmitting correction signals to the wells of the first subgroup to operate the at least one well 3 under condition of the at least one optimized gas lift parameter;

(f2) optionally, identifying 620 if the production target rate for the first sub-group 3 was not achieved by means of gas lift parameter optimization and returning to step (e) if the production target rate for the first sub-group 3 was not achieved by means of gas lift parameter optimization;

(g) setting 700 a production target rate for the second sub-group 6 to obtain the difference between the production target rate for the group 2 of wells and the production rate of the first sub-group 4, continuously repeating the setting of the production target rate for the second sub-group 6 such that a stable production rate for the group 2 of wells is obtained, and transmitting adjustment signals to the wells of the second sub-group 6;

(h) optionally, repeating 800 the steps (d1) to (g).

FIG. 2 shows an exemplary oilfield 1 comprising a control unit 1000 according to the present invention. The control unit 1000 is connected wirelessly to the wells (depicted as circles 3 and pentagons 5, with solid lines) of the oilfield 1. In further embodiments the connection may be wired. The control unit 1000 is operated according to the method 10 depicted in FIG. 1. In further embodiments the control unit 1000 may be operated according to any method according to the present invention.

In the oilfield 1 of FIG. 2 a group 2 of wells of the oilfield 1 has been selected. Further, the wells 3 being operated with gas lift have been allocated to a first sub-group 4 of the group 2 of wells. Moreover, the wells 5 being operated without gas lift have been allocated to a second sub-group 6 of the group 2 of wells.

6. LIST OF REFERENCE SIGNS

1 oilfield
2 group of wells
3 well operated with gas lift
4 group of wells being operated with gas lift
5 well operated without gas lift
6 group of wells being operated without gas lift
10 method for operating wells of an oilfield
100 selecting a group of wells
200 defining a production target rate for the group of wells
300 allocating wells being operated with gas lift to a first sub-group
400 allocating wells being operated without gas lift to a second sub-group
410 transferring a well from the second sub-group to the first sub-group
500 setting a production target rate for the first sub-group
600 monitoring the production rate of the first sub-group
610 conducting gas lift parameter optimization
620 identifying if the production target rate for the first sub-group was not achieved
700 setting a production target rate for the second sub-group
800 repeating at least one of the method steps
1000 control unit

The invention claimed is:

1. A method for operating wells of an oilfield comprising the following steps:

(a) selecting a group of wells of an oilfield;

(b) defining a production target rate for the group of wells;

(c) allocating wells being operated with gas lift to a first sub-group of the group of wells;

(d) allocating wells being operated without gas lift to a second sub-group of the group of wells;

(e) setting a production target rate for the first sub-group and conducting gas lift parameter optimization for at least one well of the first sub-group to obtain the production target rate for the first sub-group, and transmitting control signals to wells of the first sub-group to operate the at least one well under condition of at least one optimized gas lift parameter;

(f) monitoring the production rate of the first sub-group;

(g) setting a production target rate for the second sub-group to obtain the difference between the production target rate for the group of wells and the production rate of the first sub-group, and transmitting adjustment signals to the wells of the second sub-group.

2. The method according to claim 1, wherein the method further comprises continuously repeating the setting of the production target rate for the second sub-group such that a stable production rate for the group of wells is obtained.

3. The method according to claim 1, wherein the method further comprises a step of conducting gas lift parameter optimization for at least one well of the first sub-group to obtain the production target rate for the first sub-group, if the monitored production rate of the first sub-group does not meet the production target rate for the first sub-group, and preferably transmitting correction signals to the wells of the first sub-group to operate the at least one well under condition of the at least one optimized gas lift parameter.

4. The method according to claim 3, wherein the method further comprises a step of identifying if the production target rate for the first sub-group was not achieved by means of gas lift parameter optimization and returning to step (e) if the production target rate for the first sub-group was not achieved by means of gas lift parameter optimization.

5. The method according to claim 1, wherein the gas lift parameter optimization optimizes a gas lift injection rate, wherein the gas lift injection rate is optionally in a range between 0.4 and 1.5 kscf/day, further optionally between 0.5 and 1.0 kscf/day and even further optionally between 0.6 and 0.8 kscf/day.

6. The method according to claim 1, wherein the gas lift parameter optimization optimizes an oil flow rate, wherein the oil flow rate is optionally in a range between 100 and 1000 barrels/day further optionally between 150 and 900 barrels/day and even further optionally between 200 and 800 barrels/day.

7. The method according to claim 1, wherein the gas lift parameter optimization optimizes a ratio of an oil flow rate to a gas lift injection rate, wherein the ratio of an oil flow rate to a gas lift injection rate is optionally in a range between 100 and 2500 barrel/kscf, further optionally between 150 and 1800 barrel/kscf and even further optionally between 250 and 1300 barrel/kscf.

8. The method according to claim 1, wherein the gas lift parameter optimization optimizes a value for the differentiation of an oil flow rate with respect to a gas lift injection rate.

9. The method according to claim 1, wherein the gas lift parameter optimization optimizes a value for the differentiation of an oil flow rate with respect to a gas lift injection rate, wherein the value for the differentiation of an oil flow rate with respect to a gas lift injection rate is positive and/or not zero.

10. The method according to claim 1, wherein the wells being operated without gas lift are naturally flowing wells.

11. The method according to claim 1, wherein the method further comprises a step (d1) of transferring a well from the second sub-group to the first sub-group if at least one predefined threshold for the well is exceeded or undershot, wherein the threshold may be that a water cut value is higher than 40%, optionally higher than 45%, and further optionally higher than 50%.

12. The method according to claim 1, wherein the method further comprises a step (h) of repeating at least one of the steps (a), (b), (c), (d), (d1), (e), (f), (f1), (f2), (g).

13. The method according to claim 1, wherein the production target rate for the first sub-group is set to the production target rate for the entire group.

14. A computer program, comprising instructions that when carried out by at least one processor, cause the at least one processor to perform for performing a method according to claim 1.

15. A non-transitory computer readable medium having stored thereon software instructions that, when carried out by at least one processor, cause the processor to perform for performing a method according to claim 1.

16. A control unit for operating wells of an oilfield, the control unit comprising at least one processor and a memory coupled with the at least one processor; the at least one processor and memory configured to perform a method according to claim 1.

17. An oilfield comprising a control unit according to claim 16 operated to perform a method comprising the following steps:

(a) selecting a group of wells of an oilfield;
(b) defining a production target rate for the group of wells;
(c) allocating wells being operated with gas lift to a first sub-group of the group of wells;
(d) allocating wells being operated without gas lift to a second sub-group of the group of wells;
(e) setting a production target rate for the first sub-group and conducting gas lift parameter optimization for at least one well of the first sub-group to obtain the production target rate for the first sub-group, and transmitting control signals to wells of the first sub-group to operate the at least one well under condition of at least one optimized gas lift parameter;
(f) monitoring the production rate of the first sub-group;
(g) setting a production target rate for the second sub-group to obtain the difference between the production target rate for the group of wells and the production rate of the first sub-group, and transmitting adjustment signals to the wells of the second sub-group.

18. A method for operating wells of an oilfield comprising the following steps:

(a) selecting a group of wells of an oilfield;
(b) defining a production target rate for the group of wells;
(c) allocating wells being operated with gas lift to a first sub-group of the group of wells;
(d) allocating wells being operated without gas lift to a second sub-group of the group of wells;
(e) setting a production target rate for the first sub-group;
(f) monitoring the production rate of the first sub-group;
(g) setting a production target rate for the second sub-group, to obtain the difference between the production target rate for the group of wells and the production rate of the first sub-group, continuously repeating the setting of the production target rate for the second sub-group such that a stable production rate for the group of wells is obtained, and transmitting adjustment signals to the wells of the second sub-group.

19. The method according to claim 18, wherein gas lift parameter optimization for at least one well of the first sub-group is conducted to obtain the production target rate for the first sub-group, and preferably transmitting control signals to the wells of the first sub-group to operate the at least one well under condition of the at least one optimized gas lift parameter.

* * * * *